United States Patent [19]

Orlitzky et al.

[11] Patent Number: 4,762,036

[45] Date of Patent: Aug. 9, 1988

[54] SCREW DRIVER

[76] Inventors: Anton Orlitzky, 5291 - 6th Avenue, Delta, British Columbia, Canada, V4M 1L6; Albert Koehler, 2773 Pilot Drive, Coquitlam, British Columbia, Canada, V3C 3T6

[21] Appl. No.: 934,595

[22] Filed: Nov. 25, 1986

[51] Int. Cl.[4] ..... B25F 1/00

[52] U.S. Cl. ..... 81/437; 81/177.4

[58] Field of Search ..... 81/437, 438, 439, 490, 81/177.4

[56] References Cited

U.S. PATENT DOCUMENTS 1,497,363 6/1924 Döppel ..... 81/438

1,705,205 3/1929 Roams ..... 81/490

4,372,362 2/1983 Ahn ..... 81/177.4

*Primary Examiner*—Frederick R. Schmidt

*Assistant Examiner*—Maurina Rachuba

*Attorney, Agent, or Firm*—Townsend & Townsend

[57] ABSTRACT

A multi-bit screw driver is disclosed. It is ccomprised of a main body forming a handle at one end and a bit retaining heat at the other and having a plurality of bit storage locations radially positioned around said head. A bit is provided for each storage location and a centrally located bit insert in the body is used to receive the inner end of a selected bit. Means, mechanically linked with each bit is used for sliding the bit from the storage location to the central bit insert.

3 Claims, 1 Drawing Sheet

SCREW DRIVER

FIELD OF THE INVENTION

This invention relates to screw drivers and more particularly to multiple bit screw drivers.

DESCRIPTION OF THE PRIOR ART

The most common multiple bit screw driver design currently available on the market is one in which the different bits are stored in the handle of the driver. In order to interchange a bit, a threaded clasp has to be loosened to remove the bit being used from the bit insert and exchange with one of the other available bits stored in the handle of the driver. This bit exchange has to be done manually and the next bit to be used has to be sorted out of the plurality of bits which have been stored in the handle.

Accordingly, the possibility of losing a bit is fairly high as well as being time consuming. Even if the bits are stored in individual inserts or holes as part of the handle of the driver, there still exists a possibility of losing one of the bits. This procedure becomes extremely cumbersome for a user who could be handicapped, partially paralysed or even suffering from arthritis.

SUMMARY OF THE INVENTION

It is therefore an object of the present invention to provide a multiple bit screw driver which overcomes the disadvantages of the prior art designs by providing a multiple bit screw driver in which an exchange of driving bit is possible without the operator having to handle the bit itself.

Another object of the present invention is to provide a multiple bit screw driver in which the driving bit can be exchanged by the operator while using only one hand.

These and other objects of the present invention have been achieved by providing a multi-bit screw driver comprising: a main body forming a handle at one end and a bit retaining head at the other and having a plurality of bit storage locations radially positioned around said head; a bit for each storage location; an insert centrally located in said body to receive a selected bit; and means, mechanically linked with said bits, for sliding said bit from said storage position to said central bit insert.

DRAWINGS

Particular embodiments of the present invention will be understood in conjunction with the accompanying drawings in which:

FIG. 1 is a partially sectioned view of the multiple bit screw driver according to the preferred embodiment of the present invention; and FIG. 2 is a front view thereof.

DESCRIPTION OF THE PREFERRED EMBODIMENTS

Figure 1:
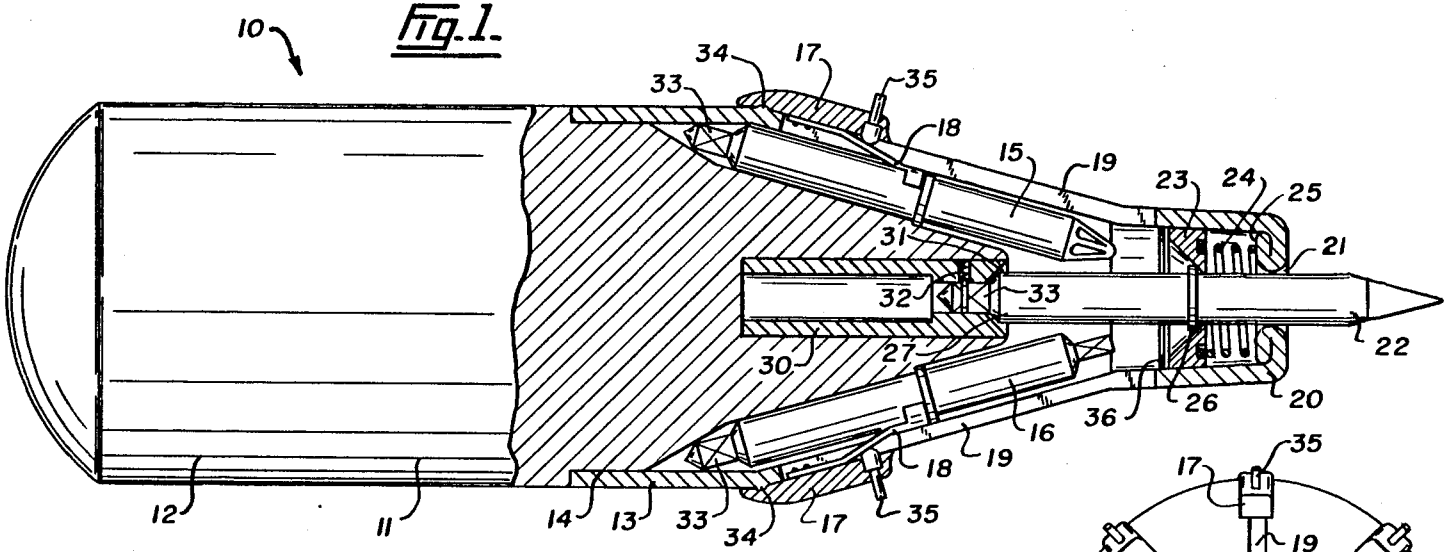

Referring now to FIG. 1 we have shown at reference numeral 10 a partially sectioned view of the multi-bit screw driver of the present invention. It comprises a main body forming a handle 12 at one end and a bit retaining head 13 at the other end. Bit retaining head 13 can either be permanently mounted to body 11 or threadedly secured thereto at the front perimeter edge 14.

The bit retaining head 13 is tapered and provided with a number of bits 15 and 16 which are positioned radially around the head 13 of screw driver 10. In this embodiment, eight bits can be adequately positioned around the perimeter of bit retaining head 13 however, a different number of bits can also be provided by either decreasing the dimension of the bits or increasing the dimension of the screw driver body and bit retaining head.

The means used in activating a selected bit comprises a sliding knob 17 which is mechanically linked to bit 15 by means of a leaf spring 18 fixedly secured to said sliding knob and said bit. The spring tension tends to pull the bit against the outer housing of bit retaining head 13. Housing 13 is provided with a number of channels 19 into which is slidably mounted knob 17. Front housing 20 of the bit retaining head 13 is provided with a centrally located aperture 21 into which is inserted a selected bit 22. Front housing 20 is provided with a wedge shaped thrust ring 23 mounted against a torsional spring 24 which rests against the inner wall 25 of front housing 20. A stopping ring 26 is provided on each bit and rests against thrust ring 23. Torsional spring 25 will apply a force against the inserted bit to permit the proper positioning of the bit's inner end 27 into a centrally located bit insert 30 which forms part of handle 12. Bit insert 30 is provided with a tapered end fitting 31 as well as a spring loaded ball socket arrangement 32 which helps to retain the inner end 27 of selected bit 22.

Each bit can be provided with a square shaped end fitting 33 adapted to be received into a similarly shaped recess of central insert 30. This will prevent the transfer of torsional forces perceived by a selected bit from affecting the shifting knob 17 and leaf spring 18. That is, the torsional forces at the tip of a selected bit will be transferred directly to the central insert 30 and dissipated through handle 12 of body 11.

Shifting knob 17 is temporarily secured in place by means of a resting step 34. The resting step 34 can be overcome by slightly shifting knob 17 forward.

In operation, once a bit has been selected, a corresponding shifting knob 17 is pushed forward to override the resting step 34. The selected bit is automatically guided downwardly into thrust ring 23 and out through aperture 21 of front housing 20. Stopping ring 26 will press against thrust ring 23 to compress spring 24. Once the shifting knob 17 has been slided to its furthest position in channel 19, the bit's inner end 27 can be aligned with central insert 30 by pressing on push-button 35 located on shifting knob 17. The downward pressure created by push-button 35 is such as to override the leaf spring tension and permit the inner end 27 of bit 22 to become aligned with central insert 30. End fitting 33 can then be inserted into the recess of insert 30 by slightly moving shifting knob 17 rearwardly.

A selected bit is returned to its storage position by simply sliding shifting knob 17 slightly forward to disengage inner end 27 from its retaining socket. The bit will then return to its position along the tapered section of bit retaining head 13. Shifting knob 17 is then slided backwards over resting step 34. Upon retrieving a selected bit, thrust ring 23 will move backward to rest against an inner ring 36.

Figure 2:
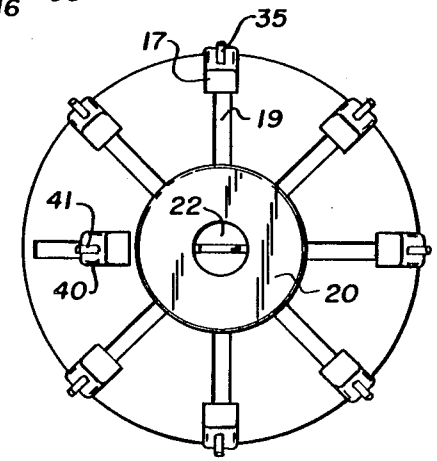

As shown in FIG. 2, the shifting knob 40 of a selected bit will rest in its forward position with pushbutton 41 depressed until it is slided slightly forward to release the inner end of the bit and then rearwardly to its original position.

I claim:

1. A single action multi-bit screw driver, comprising:

a main body forming a handle with a cylindrical shaped outer end and a tapered inner end for receiving a cone shaped bit retaining head having a plurality of bit storage locations radially positioned around said head;

a bit for each storage location, each having a useable tip at one end, a locking head at the opposite end provided with a ball socket arrangement, a stop ring between said locking head and said useable tip and means to prevent rotation of said bit when received in a locking receptacle disposed centrally in said tapered inner end of said handle adapted to receive said locking head of a selected bit, the useable tip of said bit extending through a tubular projection of said cone-shaped bit retaining head having a spring loaded wedge shaped thrust washer disposed therein for retaining said bit in said locking receptacle when said stop ring of said bit rests against said thrust ring;

actuating means on said retaining head comprising a lever connected to said bit by a leaf spring joining said lever and said bit near said locking head of said bit, said lever and said leaf spring being adapted for movement along channel means in said bit retaining head for sliding said bit from said storage locations to a resting position where said useable tip extends out of said bit retaining head;

aligning means on said actuating means adapted to align said locking head of said bit with said locking receptacle to thereby allow said head to be retained therein.

2. A multi-bit screw driver as defined in claim 1 wherein said aligning means comprises a knob resting against said leaf spring such that when depressed, said locking head of said bit will pivot towards said receptacle to thereby become align therewith.

3. A multi-bit screw driver as defined in claim 1 wherein said preventing means comprises a square shaped locking head adapted to mate with a correspondingly shaped receptacle in said tapered inner end of said handle thereby preventing rotation of said bit when said head is inserted in said receptacle.

* * * * *